United States Patent [19]

Burton, III et al.

[11] 3,941,421

[45] Mar. 2, 1976

[54] APPARATUS FOR OBTAINING UNIFORM GAS FLOW THROUGH AN IN SITU OIL SHALE RETORT

[75] Inventors: Robert S. Burton, III, Grand Junction, Colo.; Chang Yul Cha, LaVerne, Calif.; Richard D. Ridley, Grand Junction, Colo.

[73] Assignee: Occidental Petroleum Corporation, Los Angeles, Calif.

[22] Filed: Aug. 13, 1974

[21] Appl. No.: 496,968

[52] U.S. Cl. ..... 299/2; 202/257; 208/11 R

[51] Int. Cl.[2] ..... E21C 41/10

[58] Field of Search ..... 196/98–103, 196/155, 136; 202/257, 261; 48/89, 113; 299/2; 208/11

[56] References Cited

UNITED STATES PATENTS 1,328,468 1/1920 Wellman ..... 48/113 X 3,448,794 6/1969 Medlen ..... 202/257 X

*Primary Examiner*—Ernest R. Purser

*Attorney, Agent, or Firm*—Christie, Parker & Hale

[57] ABSTRACT

An in situ oil shale retort in which a cavity filled with broken particles of oil shale is formed within the subsurface oil shale formation and air is forced down through the cavity to sustain combustion of the top layer of oil shale particles. The products of combustion are withdrawn through a plurality of transverse exhaust pipes at the bottom of the cavity, the exhaust pipes each being provided with a series of holes along the length of the pipes within the cavity, the holes being graded in size to compensate for the pressure drop along the length of the pipe so as to provide substantially equal volume of gas flow through each of the openings.

4 Claims, 3 Drawing Figures

APPARATUS FOR OBTAINING UNIFORM GAS FLOW THROUGH AN IN SITU OIL SHALE RETORT

FIELD OF THE INVENTION

This invention relates to in situ retorting of oil shale, and more particularly, is concerned with equalizing the air flow distribution through the cross-sectional area of the retort cavity,

BACKGROUND OF THE INVENTION

In situ retorting of oil shale to recover the liquid and gaseous carbonaceous values present in the shale has heretofore been proposed. One such arrangement is described in U.S. Pat. No. 3,661,423 assigned to the same assignee as the present invention. The in situ retorting process described in this patent involves forming a cavity in the oil shale formation in which the cavity is filled with oil shale particles. Air is brought in at the top of the cavity to sustain combustion of the top layer of the oil shale particles. The hot products of combustion pass downwardly through the lower layers of oil shale particles and are withdrawn at the bottom of the cavity. This heats the oil shale particles up sufficiently to drive off the liquid and carbonaceous values from the oil shale particles. The liquid values accumulate at the bottom of the cavity and the carbonaceous values are withdrawn along with the product gases through a pipe terminating adjacent the bottom of the cavity.

While the in situ recovery process described in the patent is effective in the recovery of oil from oil shale, it has been found that the flow of air and product gases down through the retort may not be evenly distributed over the cross-sectional area of the cavity. As a result, the burning rate may not be uniform and the retorting may not proceed as efficiently in some areas as others. As a result, the entire volume of oil shale particles may not be completely retorted, thereby greatly decreasing the overall efficiency of the retorting process.

SUMMARY OF THE INVENTION

In copending application Ser. No. 496,969, filed Aug. 13, 1974, entitled "Gas Collection System for Oil Shale Retort" and assigned to the same assignee as the present invention, there is described an arrangement for exhausting the product gases from the bottom of the cavity utilizing a plurality of parallel pipes adjacent the bottom of the cavity. The present invention is an improvement on the arrangement disclosed in the copending application in that the series of openings along the length of each of the exhaust pipes is graded in size from the largest hole near the closed end of the pipe to the smallest hole near the end of the exhaust pipe where it exits from the cavity. The size of the holes are graded in a manner which provides substantially equal flow rate through the repsective openings irrespective of the internal pressure gradient within the pipes resulting in a different pressure gradient across the respective openings or orifices.

BRIEF DESCRIPTION OF THE DRAWINGS

For a better understanding of the invention reference should be made to the accompanying drawings, wherein.

DETAILED DESCRIPTION

Figure 1:
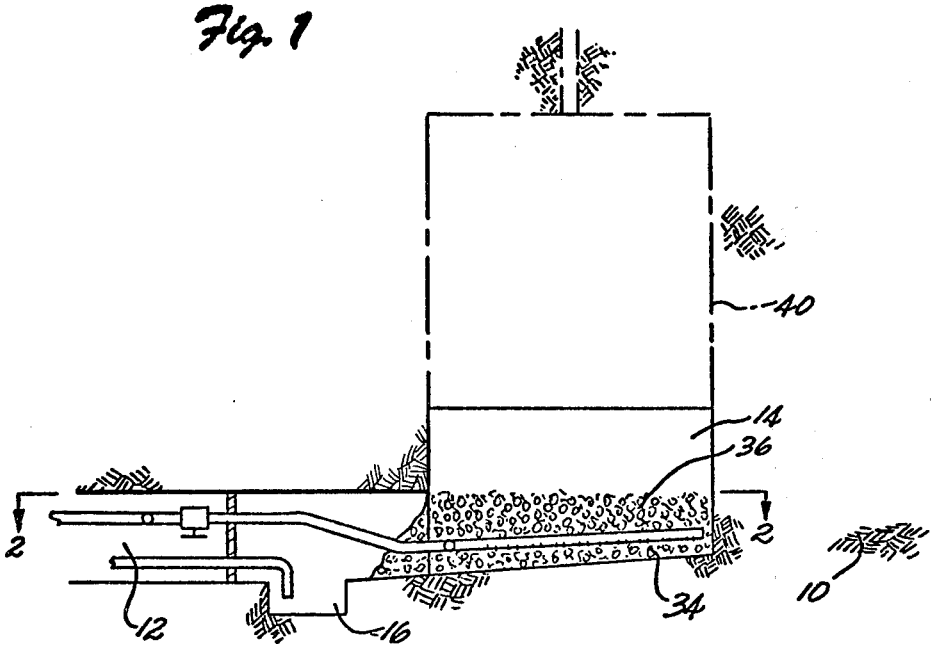
FIG. 1 is a sectional view in elevation of an in situ retort incorporating the features of the present invention.
Figure 2:
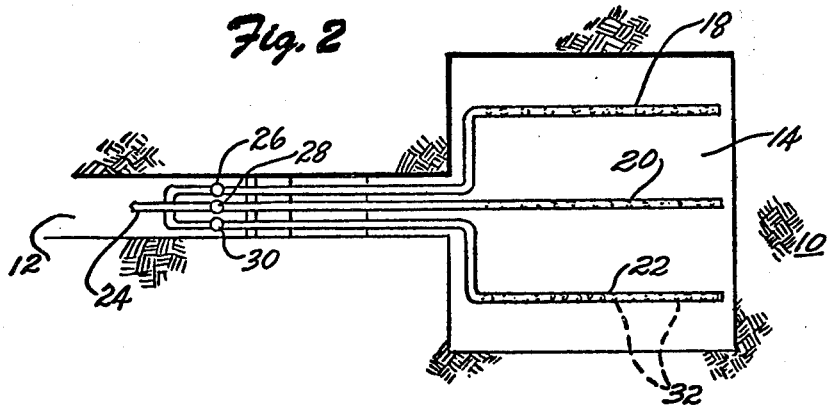
FIG. 2 is a cross sectional view taken substantially on the line 2—2 of FIG. 1.

Referring to the drawings in detail, number 10 indicates generally a subsurface formation of oil bearing shale of the type commonly found in the Rocky Mountain region of the United States. An in situ retort is provided in the oil shale formation by means of a substantially horizontal access tunnel 12 which communicates with the surface of the ground. The inner end of the tunnel 12 is excavated and enlarged to form an upwardly extending chamber 14. The chamber 14 is blasted or otherwise cut out of the oil shale formation, and the shale material excavated in forming the chamber is removed through the tunnel 12. A sump 16 is provided in the floor of the tunnel 12 outside of the chamber 14 and serves as a collection point for the liquids driven off from the oil shale during the retorting process.

After the chamber 14 is formed, pipes for exhausting the gaseous products are run into the lower portion of the chamber 14. In the drawings, three parallel pipe sections 18, 20 and 22 are shown, but the number of pipes may be increased, depending upon the size of the retort chamber. The three parallel pipes are brought out through the tunnel 12 where they are preferably connected to a common outlet-pipe 24 through a manifold and separate control valves 26, 28, and 30, respectively. The three valves can be individually adjusted to modify the gas flow in the respective pipes. The pipe 24 may be connected to a suitable pump or blower in the manner described in copending application Ser. No. 492,923, filed July 29, 1974, and entitled "Method and Apparatus for Retorting Oil Shale at Subatmospheric Pressure" and assigned to the same assignee as the present invention.

The respective pipes 18, 20, and 22, within the chamber 14, are provided with a series of holes, as indicated at 32, distributed along the undersides of the pipes. The pipes are supported off the bottom of the chamber 14 on mounds of rock fill placed under the pipes to the depth of approximately one foot. The lower part of the chamber 14 is then filled with oil shale particles to a depth of 4 or 5 feet, completely covering over the pipes 18, 20, and 22 with a protective layer of oil shale, as indicated at 36. By placing the holes 32 on the underside of the pipes, gases are able to enter the pipes through the coarse rock fill 34 on which the pipes are supported while, at the same time, the holes are protected against being clogged by solid particles or liquids during the retorting process.

Once the exhaust pipes are in place in the manner described hereinabove, blasting charges are set in the oil shale formation above the chamber 14. An enlarged cavity is formed in the oil shale formation by setting off the charges, the enlarged cavity forming an upward extension of the chamber 14. This enlarged cavity, indicated at 40, is filled with particles of oil shale formed during the blasting operation.

The pipes 18, 20 and 22 are preferably made of an 8 inch diameter pipe having a very thick wall, for example, Schedule 80 pipe, to withstand the force of the blasting operation. The pipe is further protected from damage by the overlying layer 36 of oil shale which is put in place before the blasting operation.

Once the blasting operation is completed, vents are opened to atmosphere in the top of the retort cavity to permit air to be drawn into the cavity at the top. The oil shale is ignited and burning proceeds. The hot product gases are drawn down through the cavity and out the exhaust pipes. By adjusting the valves, the flow rate through the respective pipes can be balanced to produce uniform burning.

Figure 3:
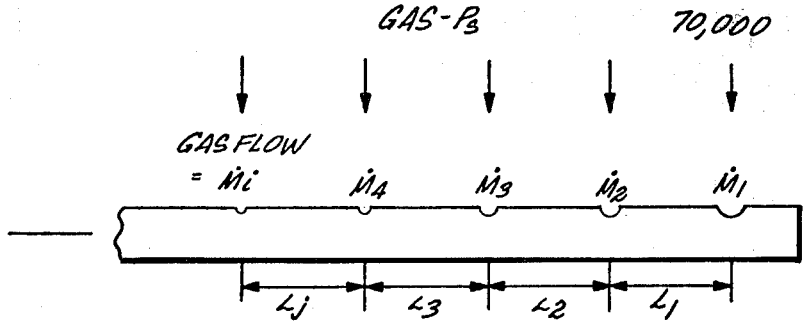
FIG. 3 is a cross-sectional view of one of the exhaust pipes used in explaining the operation of the invention.

Referring to FIG. 3, a distributor pipe is shown with a series of orifices numbered 1 through i spaced at intervals $L$ along the pipe. According to the present invention, the size of the orifices are selected so that the mass flow rate $\dot{M}_i$ through each orifice is made equal to that of all the other orifices by changing the orifice diameter $D_{oi}$ of the orifices to compensate for pressure drop along the interior of the pipe.

The size of the orifices to accomplish this result can be determined as follows. The pressure drop $\Delta P_{oi}$ across each orifice i is the difference between the external pressure $P_s$ relative to the internal pressure $P_i$ inside the pipe at the orifice, namely, $$\Delta P_{oi} = P_s - P_i \tag{1}$$

The pressure $P_i$ at any orifice is the sum of the incremental pressure drops $\Delta P_{Lj}$ successive sections of pipe $L_{1\rightarrow j}$ starting with pressure $P_1$ at orifice 1. This can be expressed by the euation $$P_1 = P_1 + \sum_{j=1}^{j=i-1} \Delta P_{Lj} \tag{2}$$

Substituting (2) into (1) gives $$\Delta P_{oi} = P_s - P_1 + \sum_{j=1}^{1=i-1} \Delta P_{Lj} = \Delta P_{o1} + \sum_{j=1}^{j=i-1} \Delta P_{Lj} \tag{3}$$

Thus by knowing the pressure drop across the first orifice and the pressure drops from orifice to orifice, the pressure drop through each subsequent orifice can be calculated.

The term $\Delta P_{Lj}$ in equation (3) represents a drop in pressure due to flow through an incremental length $L_j$ of the pipe. The volume of flow of course increases with each orifice by a unit amount since all orifices by definition provide equal flow. Thus the flow between the second and third orifices is twice the flow through the pipe between the first and second orifices. A standard equation for calculating pressure drop due to flow of a gas through a pipe (the Fanning Friction equation) is:

$$\Delta P_L = 2f\mu^2 \rho \; l/gd_i \tag{4}$$

where $\Delta P$ is the pressure drop in lbs/ft.$^2$
$f$ is the friction factor (a function Reynolds number)
$\mu$ is velocity of flow in ft/sec
$L$ is pipe length
$\rho$ is gas density
$g$ is gravitational constant (32 ft/sec$^2$)
$d$ is inside diameter in ft.

Equation (4) can be rewritten as $$\Delta P_L = 3.62\, fQ^2P^2L/Pa\; d^5T \tag{5}$$

where $\Delta P_L$ is an inches of water
$Q$ is actual flow rate in cubic feet per minute
$P$ is initial absolute pressure
$T$ is absolute temperature
$Pa$ is average absolute pressure (psi) over length $L$
$d$ is inside diameter in inches Using equation (5), the pressure drop between any two orifices can be calculated since the flow rate $Q_{Lj}$ is equal to $Q_{L1} \cdot$ j. This gives $$\Delta P_{Lj} = 3.62\, f(Q_1 j\; P_j)^2\; L/Pad^5T \tag{6}$$

The standard orifice equation for determining flow rate $\dot{M}$ through a particular orifice given the pressure drop $P_{oi}$ across the orifice is $$\dot{M}_i = 0.61\; S_{oi}\; (2g\; \Delta P_{oi}\; \rho)^{0.5} \tag{7}$$

where $S_{oi}$ is orifice area $$\left(= \frac{\pi D^2}{4}\right)$$

$g$ is gravitational constant
$\rho$ is gas density
D is orifice diameter

In order that the flow through each orifice is the same $$\frac{\dot{M}_i}{M_{i+1}} = 1 = \frac{D_{oi}^2 \cdot \Delta P_{oi}^{1/2}}{D_{oi+1}^2 \cdot \Delta P_{oi+1}^{1/2}} \tag{8}$$

Using the above equations, the orifice diameters can be determined as follows: knowing the total flow required for the process, the number of pipes and size of pipes are selected so that the maximum flow per pipe is within acceptable limits. The length of pipe is determined by the size of the retort cavity. The number of holes is selected to give good flow distribution. Assuming equal flow through each orifice, the flow rate $\dot{M}$ per orifice is determined by dividing the total required flow by the total number of orifices. A diameter $D_1$ for the first orifice is then selected, e.g., 25 to 50 percent of pipe diameter. Using equation (7), $\Delta P_{o1}$ is then calculated. Using equation (1), $P_1$ is then determined. Knowing $P_1$, equation (6) is solved for the value of $\Delta P_{L1}$. Using equation (3), the value of $\Delta P_{02}$ is then determined. Knowing $\Delta P_{02}$, equation (8) is solved for $D_2$. $P_2$ is then obtained from a solution of equation (2). These steps are repeated starting with the solution for $\Delta P_{L2}$ from equation (6), $\Delta P_{03}$ from equation (3), $D_3$ from equation (8), and $P_3$ from equation (2), et cetera.

An example of one embodiment for a cavity 35 × 35 feet is to use three 6 inch pipes (5.761 inchesID) with sets of three holes spaced at 2 foot intervals, making 18 sets of holes in each pipe. Required gas flow per pipe is 1277 cfm or 23.6 cfm per hole. This gives a value of $\dot{M}$ = .019 No./sec per hole.

With a selected diameter of the first set of holes of 2 inch and a static pressure in the cavity of $P_s$ = 27.75 inches of $H_2O$, the following calculated values are determined following the above-outlined procedure.

| | $P_i$, in. $H_2O$ | $P_{Li}$ in. $H_2O$ | $P_{oi}$, in. $H_2O$ | $D_{oi}$, in. |
|---|---|---|---|---|
| 1. | 27.648 | 0.00078 | 0.102 | 2 |
| 2. | 27.647 | 0.00311 | 0.103 | 1.99 |
| 3. | 27.644 | 0.00699 | 0.106 | 1.98 |
| 4. | 27.637 | 0.01243 | 0.113 | 1.95 |
| 5. | 27.625 | 0.01942 | 0.125 | 1.90 |
| 6. | 27.605 | 0.02797 | 0.145 | 1.83 |
| 7. | 27.577 | 0.03807 | 0.173 | 1.75 |
| 8. | 27.539 | 0.04972 | 0.211 | 1.67 |
| 9. | 27.4895 | 0.06293 | 0.261 | 1.58 |
| 10. | 27.42658 | 0.07770 | 0.323 | 1.50 |
| 11. | 27.34888 | 0.09401 | 0.401 | 1.42 |
| 12. | 27.2549 | 0.11188 | 0.495 | 1.35 |
| 13. | 27.14299 | 0.13131 | 0.607 | 1.28 |
| 14. | 26.9907 | 0.15228 | 0.759 | 1.21 |
| 15. | 26.8384 | 0.17482 | 0.912 | 1.16 |
| 16. | 26.6636 | 0.19890 | 1.086 | 1.11 |
| 17. | 26.4647 | 0.22454 | 1.285 | 1.06 |
| 18. | 26.2402 | — | 1.510 | 1.02 |

What is claimed is:

1. An in situ oil shale retort comprising:

a cavity within a subsurface oil shale formation substantially filled with broken particles of oil shale;

a tunnel extending into the cavity adjacent the bottom of the cavity;

a plurality of gas exhaust pipes traversing the bottom of the cavity;

means supporting the pipes above the bottom of the cavity, said pipes extending into the tunnel, said pipes having a plurality of holes in the portions of said pipes traversing the bottom of the cavity, said holes being graded in size along the length of said pipes with the smallest holes being adjacent the end of the exhaust pipes where the exhaust pipes enter the tunnel; and means connected to said pipes for withdrawing gas through the pipes from the cavity.

2. Apparatus of claim 1 wherein the holes are circular and the largest hole is substantially smaller in diameter than the internal diameter of the pipe.

3. Apparatus of claim 2 wherein the diameter $D_{oi}$ of a hole at one location i along the pipe is related to the diameter $D_{oi+1}$ of a hole at the next location $i+1$ in the direction of fluid flow by the relation $$\frac{D_{oi}^2}{D_{oi+1}^2} = \sqrt{\frac{\Delta P_{oi+1}}{\Delta P_{oi}}}$$

when $\Delta P_{oi}$ is the pressure differential at the hole between the outside and inside of the pipe.

4. Apparatus of claim 2 wherein each pipe includes more than one hole at each spaced location along the pipe, the holes at any given location being equal in size.

* * * * *

UNITED STATES PATENT OFFICE

CERTIFICATE OF CORRECTION

Patent No. 3,941,421 Dated March 2, 1976

Inventor(s) Robert S. Burton, III, et al.

It is certified that error appears in the above-identified patent and that said Letters Patent are hereby corrected as shown below:

Column 2, line 39, "492,923" should read --- 492,823 ---.

Column 3, line 31, "euation" should read --- equation ---.

Signed and Sealed this

Twenty-sixth Day of April 1977

[SEAL]

*Attest:*

RUTH C. MASON
*Attesting Officer*

C. MARSHALL DANN
*Commissioner of Patents and Trademarks*